US007972147B2

(12) United States Patent
Kiryu et al.

(10) Patent No.: US 7,972,147 B2
(45) Date of Patent: Jul. 5, 2011

(54) CONNECTOR APPARATUS

(75) Inventors: Koichi Kiryu, Shimotakai-gun (JP); Koki Sato, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 0 days.

(21) Appl. No.: 12/793,974

(22) Filed: Jun. 4, 2010

(65) Prior Publication Data

US 2010/0317235 A1 Dec. 16, 2010

(30) Foreign Application Priority Data

Jun. 10, 2009 (JP) ..... 2009-138839

(51) Int. Cl.
*H01R 12/00* (2006.01)

(52) U.S. Cl. ..... 439/79

(58) Field of Classification Search ..... 439/290, 439/291, 682, 825, 856, 857
See application file for complete search history.

(56) References Cited

U.S. PATENT DOCUMENTS

| | | | | |
|---|---|---|---|---|
| 4,012,105 | A * | 3/1977 | Biddle | 439/675 |
| 5,197,908 | A * | 3/1993 | Nelson | 439/825 |
| 7,666,031 | B2 | 2/2010 | Kumamoto et al. | |
| 2006/0281354 | A1* | 12/2006 | Ngo et al. | 439/290 |

FOREIGN PATENT DOCUMENTS

JP 2008-218003 9/2008

* cited by examiner

*Primary Examiner* — Phuong K Dinh
(74) *Attorney, Agent, or Firm* — IPUSA, PLLC

(57) ABSTRACT

A connector apparatus is provided having a first connector including a first contact part with first and second contact terminals connected by a first connection part and a space therebetween, the second contact terminal being bent such that the space between the first and second contact terminals becomes narrower, a second connector engageable to the first connector and including a second contact part with third and fourth contact terminals connected by a second connection part and a space therebetween, the fourth contact terminal being bent such that the space between the third and fourth contact terminals becomes wider. When the first and second connectors are engaged, the first and second contact parts are connected having the third and fourth connection terminals sandwiched between the first and second connection terminals, having the first contact terminal contact the fourth contact terminal, and having the second contact terminal contact the third contact terminal.

12 Claims, 5 Drawing Sheets

CONNECTOR APPARATUS

BACKGROUND OF THE INVENTION

1. Field of the Invention

The present invention generally relates to a connector apparatus, and more particularly to a connector apparatus for providing a highly reliable connection.

2. Description of the Related Art

In controlling automobiles and the like, electronic controls are performed. Connector apparatuses are used to connect controlling devices and devices controlled by the controlling devices inside an automobile, for example.

As one example of a conventional connector apparatus, Japanese Laid-Open Patent Publication No. 2008-218003 discloses a connector apparatus having a pair of connectors, in which one is a male connector (hereinafter also referred to as "inserting connector") and the other is a female connector (hereinafter also referred to as "receiving connector"). The connector apparatus achieves connection by engaging the inserting connector and the receiving connector. There are various types of connector apparatuses.

For example, in a case where a connector apparatus having a pair of connectors is used for an automobile, the contact points of the connectors might deviate from its intended areas due to the constant vibration created when the automobile is in operation. In a case where the electrical connection is disconnected by the deviation, controls of the automobile cannot be performed.

SUMMARY OF THE INVENTION

The present invention may provide a connector apparatus that substantially eliminates one or more of the problems caused by the limitations and disadvantages of the related art.

Features and advantages of the present invention will be set forth in the description which follows, and in part will become apparent from the description and the accompanying drawings, or may be learned by practice of the invention according to the teachings provided in the description. Objects as well as other features and advantages of the present invention will be realized and attained by a connector apparatus particularly pointed out in the specification in such full, clear, concise, and exact terms as to enable a person having ordinary skill in the art to practice the invention.

To achieve these and other advantages and in accordance with the purpose of the invention, as embodied and broadly described herein, an embodiment of the invention provides a connector apparatus including: a first connector including a first contact part, the first contact part including first and second contact terminals connected by a first connection part, the first and second contact terminals having a space therebetween, the second contact terminal being bent in a manner that the space between the first and second contact terminals becomes narrower; a second connector engageable to the first connector and including a second contact part, the second contact part including third and fourth contact terminals connected by a second connection part, the third and fourth contact terminals having a space therebetween, the fourth contact terminal being bent in a manner that the space between the third and fourth contact terminals becomes wider; wherein when the first and second connectors are in an engaged state, the first contact part and the second contact part are connected in a manner having the third and fourth connection terminals sandwiched between the first and second connection terminals, having the first contact terminal contact the fourth contact terminal, and having the second contact terminal contact the third contact terminal.

Other objects and further features of the present invention will be apparent from the following detailed description when read in conjunction with the accompanying drawings.

DESCRIPTION OF THE PREFERRED EMBODIMENTS

In the following, embodiments of the present invention will be described with reference to the accompanying drawings.

As described below, a connector apparatus 100 according to an embodiment of the present invention is for establishing an electrical connection by connecting one of a pair of connectors (hereinafter also referred to as "first connector") 20 to the other one of the pair of connectors (hereinafter also referred to as "second connector") 60. When the first and second connectors 20, 60 are connected, a connection is established at two contact points.

(First Connector)

Figure 1:
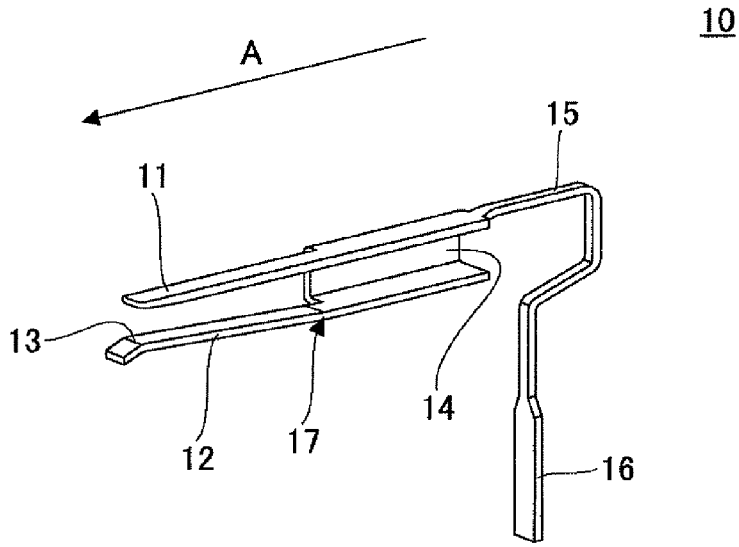
FIG. 1 is a perspective view illustrating a contact part of a first connector according to an embodiment of the present invention.

A contact part 10 of a first connector 20 according to an embodiment of the present invention is described with reference to FIG. 1. It is to be noted that the first connector 20 is not illustrated in FIG. 1. The contact part 10 is formed of a conductive material such as metal. The contact part 10 has a first contact terminal 11 and a second contact terminal 12 extending in an inserting direction A. The first and second contact terminals 11, 12 are arranged substantially in parallel. The first and second contact terminals 11, 12 have cross section surfaces positioned orthogonal to the inserting direction A. The cross-sectional surfaces of the first and second contact terminals 11, 12 are formed having a substantially rectangular shape and a wide plane facing one another.

The first contact terminal 11 is formed substantially in a straight line along the inserting direction A. The second contact terminal 12 is bent inward at a bent part 17 at a center portion thereof, so that the space between the first and second contact terminals 11, 12 becomes narrower at the distal end parts of the first and second contact terminals 11, 12.

The second contact terminal 12 has a resilient (spring) property. The second contact terminal 12 can be displaced in a manner that the space between the distal end parts becomes wider or narrower. The second contact terminal 12 has a distal end part forming a downward facing obtuse v-shape. The region in which the space between the first and second contact terminals 11, 12 is narrowest is a contact region 13. The contact region 13 is where the contact part 10 of the first contact 20 is connected to the below-described contact part 50 of the below-described second contact 60.

The first and second contact terminals 11, 12 are electrically connected at a connection part 14. The contact part 10 has a lead part 15 extending in a direction opposite to the inserting direction A. In FIG. 1, although the lead part 15 is formed in a manner extending in a direction opposite to the inserting direction, the portion of the connection part 14 may be formed in a direction opposite to the inserting direction A. A lead terminal 16 is formed at a distal end of the lead part 15. The lead terminal 16 is for connecting with, for example, a printed circuit board.

In forming the contact part 10, a member having a predetermined shape is punched out from, for example, a metal material. Then, the metal member is bent substantially in a right angle at a part between the connection part 14 and the first contact terminal 11 and bent substantially in a right angle at a part between the connection part 14 and the second contact terminal 12. Thereby, the first contact terminal 11 and the second contact terminal 12 are formed facing each other. Accordingly, the first and second contact terminals 11, 12 of the contact part 10 can be formed with the same material. Thus, the contact part 10 can be easily manufactured at a low cost. It is to be noted that the first and second contact terminals 11, 12 may be formed in a manner facing each other by forming the connection part 14 in a U-letter shape.

Figure 2:
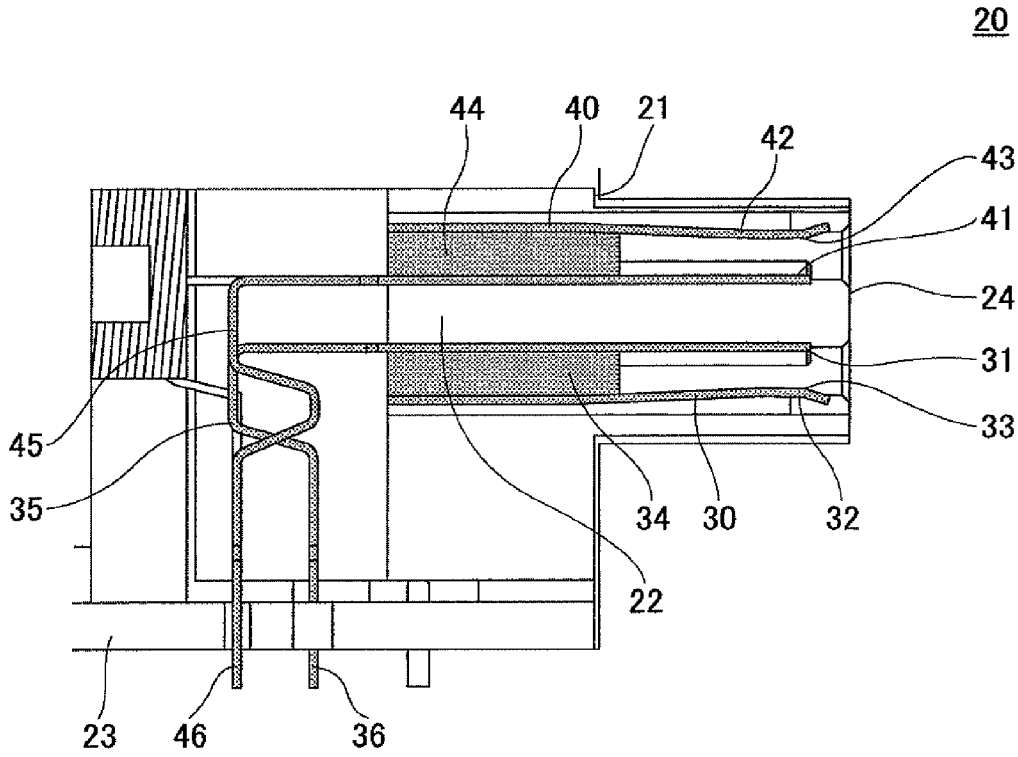
FIG. 2 is a schematic diagram illustrating a structure of a first connector according to an embodiment of the present invention.

Next, the first connector 20 according to an embodiment of the present invention is described with reference to FIG. 2. In this embodiment, the first connector 20 has a first contact part 30 and a second contact part 40 in which each contact part 30, 40 has substantially the same configuration as the above-described contact part 10. The first connector 20 includes a housing 21 in which the first and second contact parts 30, 40 are installed. An insulation material 22 is formed between the first and second contact parts 30, 40 for maintaining an insulating state.

Similar to the configuration of the above-described contact part 10, the first contact part 30 includes a first contact terminal 31, a second contact terminal 32, a contact region 33, a connection part 34, a lead part 35, and a lead terminal 36. The first contact part 30 has the second contact terminal 32 positioned at an outer side of the housing part 21 and the first contact terminal 31 positioned at an inner side of the housing part 21.

Although the second contact part 40 also includes components/parts corresponding to the first contact terminal 11, the second contact terminal 12, the contact region 13, and the connection part 14 of the contact part 10, the second contact part 40 includes a lead part 45 having a shape different from the lead part 15 of the contact part 10. The lead part 45 is bent to an opposite side of the first contact part 30. More specifically, the second contact part 40 includes a first contact terminal 41, a second contact terminal 42, a contact region 43, and a connection part 44 having the same configuration as those of the contact part 10. However, unlike the lead part 35 of the first contact part 30, the lead part 45 is bent toward the first contact terminal 41. Further, the lead part 45 is formed longer than the lead part 35 because the second contact part 40 is positioned above the first connector 20. Further, a lead terminal 46 is formed on a distal end of the lead part 45. The lead terminal 46 and the lead terminal 36 are connected to a substrate (e.g., printed circuit board) 23. The second contact part 40 has the second contact terminal 42 positioned at an outer side of the housing part 21 and the first contact terminal 41 positioned at an inner side of the housing part 21.

In a connection plane 24 (plane which is to connect with the below-described second connector 60), the first connector 20 has the second connection terminal 42, the first connection terminal 41, the first connection terminal 31, and the second connection terminal 32 arranged in this order from an upper side in FIG. 2.

(Second Connector)

Figure 3:
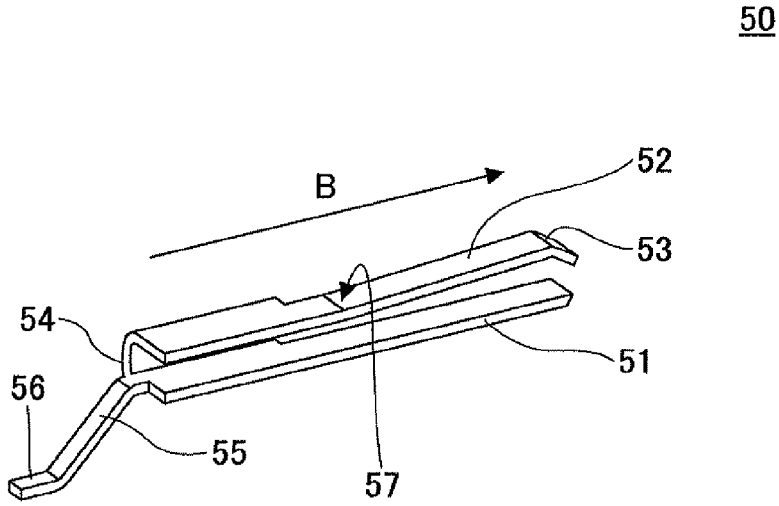
FIG. 3 is a perspective view illustrating a contact part of a second connector according to an embodiment of the present invention.

Next, the contact part 50 of the second connector 60 according to an embodiment of the present invention is described with reference to FIG. 3. It is to be noted that the second connector 60 is not illustrated in FIG. 3. The contact part 50 is formed of a conductive material such as metal. The contact part 50 has a third contact terminal 51 and a fourth contact terminal 52 extending in an inserting direction B. The third and fourth contact terminals 51, 52 are arranged substantially in parallel. The third and fourth contact terminals 51, 52 have cross-sectional surfaces positioned orthogonal to the inserting direction B. The cross-sectional surfaces of the third and fourth contact terminals 51, 52 are formed having a substantially rectangular shape and a wide plane facing one another.

The third contact terminal 51 is formed substantially as a straight line along the inserting direction B. The fourth contact terminal 52 is bent outward at a bent part 57 at a center portion thereof, so that the space between the third and fourth contact terminals 51, 52 becomes wider at the distal end parts of the third and fourth contact terminals 51, 52.

The fourth contact terminal 52 has a resilient (spring) property. The fourth contact terminal 52 can be displaced in a manner that the space between the distal end parts becomes wider or narrower. The fourth contact terminal 52 has a distal end part forming a downward facing obtuse v-shape. The region in which the space between the third and fourth contact terminals 51, 52 is widest is a contact region 53. The contact region 53 is where the contact part 50 of the second contact 60 is connected to the above-described contact part 10 of the above-described first contact 20.

The third and fourth contact terminals 51, 52 are electrically connected at a connection part 54. The contact part 50 has a lead part 55 extending in a direction opposite to the inserting direction B. In FIG. 3, although the lead part 55 is formed in a manner extending in a direction opposite to the inserting direction B, the portion of the connection part 54 may be formed in a direction opposite to the inserting direction B. A lead terminal 16 is formed at a distal end of the lead part 55. The lead terminal 56 is for connecting with, for example, a printed circuit board.

In forming the contact part 50, a member having a predetermined shape is punched out from, for example, a metal material. Then, the metal member is bent substantially in a right angle at a part between the connection part 54 and the third contact terminal 51 and bent substantially in a right angle at a part between the connection part 54 and the fourth contact terminal 52. Thereby, the third contact terminal 51 and the fourth contact terminal 52 are formed facing each other. Accordingly, the third and fourth contact terminals 51, 52 of the contact part 50 can be formed with the same material. Thus, the contact part 50 can be easily manufactured at a low cost. It is to be noted that the third and fourth contact terminals 51, 52 may be formed in a manner facing each other by forming the connection part 54 in a U-letter shape.

Next, the second connector 60 according to an embodiment of the present invention is described with reference to FIG. 4.

In this embodiment, the second connector 60 has a first contact part 70 and a second contact part 80 in which each contact part 70, 80 has substantially the same configuration as the above-described contact part 50. The second connector 60 includes a housing 61 in which the first and second contact parts 70, 80 are installed. An insulation material 62 is formed between the first and second contact parts 70, 80 for maintaining an insulating state.

Figure 4:
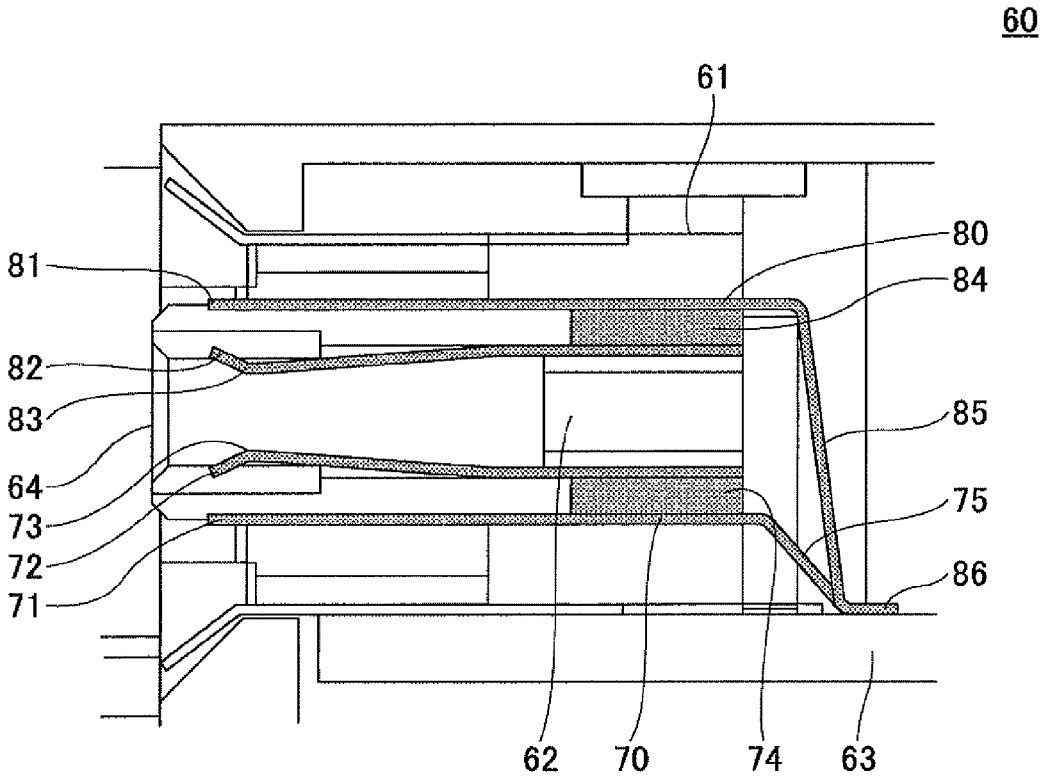
FIG. 4 is a schematic diagram illustrating a structure of a second connector according to an embodiment of the present invention.

Similar to the configuration of the above-described contact part 50, the first contact part 70 includes a third contact terminal 71, a fourth contact terminal 72, a contact region 73, a connection part 74, a lead part 75, and a lead terminal (not illustrated in FIG. 4). The first contact part 70 has the third contact terminal 71 positioned at an outer side of the housing part 61 and the fourth contact terminal 42 positioned at an inner side of the housing part 61.

Although the second contact part 80 also includes components/parts corresponding to the third contact terminal 51, the fourth contact terminal 52, the contact region 53, and the connection part 54 of the contact part 50, the second contact part 80 includes a lead part 85 having a shape different from the lead part 55 of the contact part 50. The lead part 85 is bent to an opposite side of the first contact part 70. More specifically, the second contact part 80 includes a third contact terminal 81, a fourth contact terminal 82, a contact region 83, and a connection part 84 having the same configuration as those of the contact part 50. However, unlike the lead part 75 of the first contact part 70, the lead part 85 is bent toward the fourth contact terminal 82. Further, the lead part 85 is formed longer than the lead part 75 because the second contact part 80 is positioned above the second connector 60. Further, a lead terminal 86 is formed on a distal end of the lead part 85. The lead terminal 86 and the lead terminal (not illustrated) of the first contact part 70 are connected to a substrate (e.g., printed circuit board) 63. The second contact part 80 has the third contact terminal 81 positioned at an outer side of the housing part 61 and the fourth contact terminal 82 positioned at an inner side of the housing part 61.

In a connection plane 64 (plane which is to connect with the first connector 20), the second connector 60 has the third connection terminal 81, the fourth connection terminal 82, the fourth connection terminal 72, and the third connection terminal 71 arranged in this order from an upper side in FIG. 4.

(Engaged State)

Figure 5:
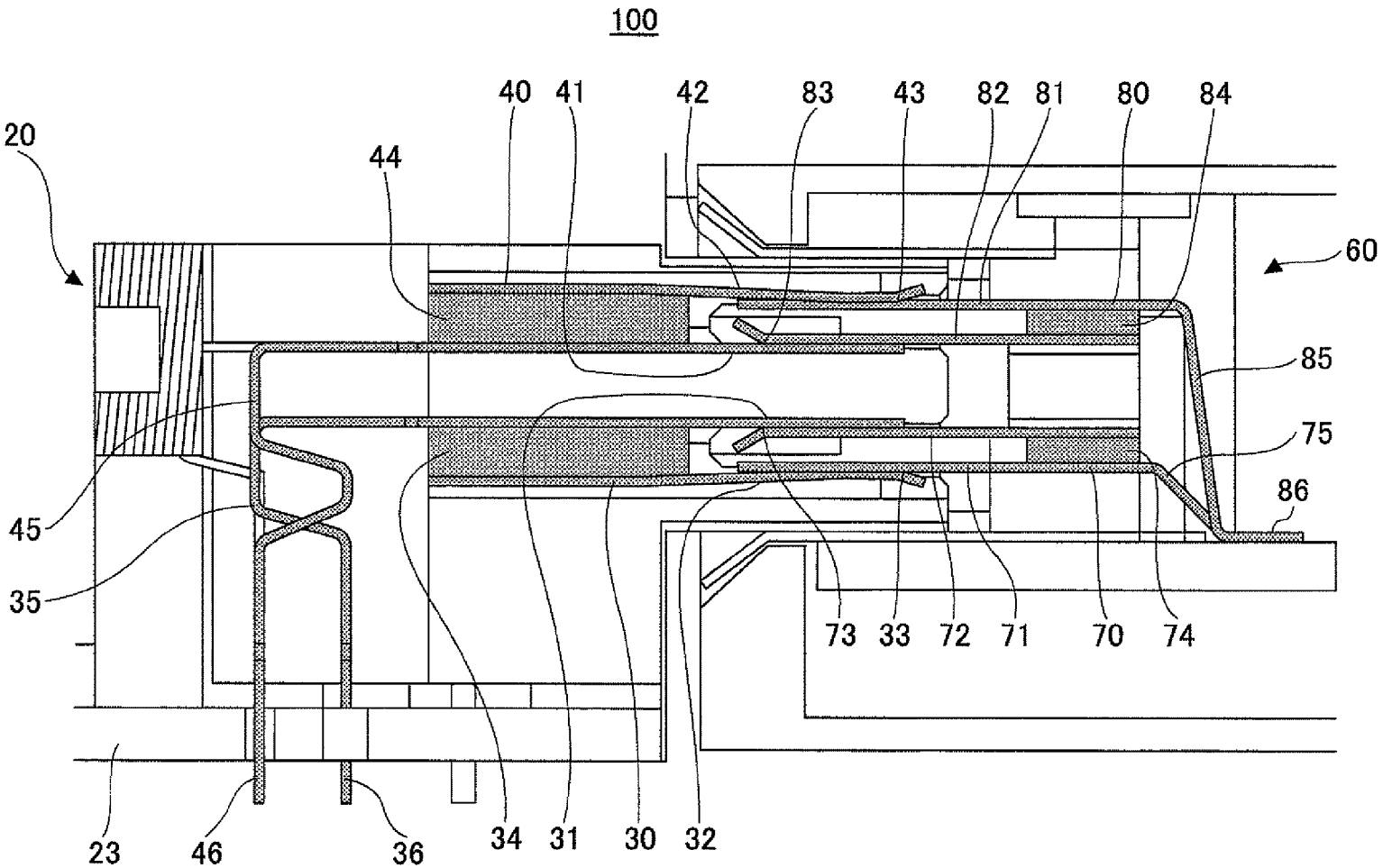
FIG. 5 is a schematic diagram illustrating a connector apparatus having first and second connectors in an engaged state according to an embodiment of the present invention.

Next, an engaged state of the first and second connectors 20, 60 according to an embodiment of the present invention is described with reference to FIG. 5. FIG. 5 illustrates a connector apparatus 100 having the first and second connectors 20, 60 in an engaged state according to an embodiment of the present invention. In engaging the first and second connectors 20, 60, the first and second connectors 20, 60 are positioned so that the connection plane 24 of the first connector 20 faces the connection plane 64 of the second connector 60. Then, as illustrated in FIG. 5, the first and second connectors 20, 60 are engaged. By the engagement, the first contact part 30 of the first connector 20 is connected to the first contact part 70 of the second connector 60, and the second contact part 40 of the first contact part 20 is connected to the second contact part 80 of the second connector 60.

That is, the first and second connectors 20, 60 are connected in a manner having the third and fourth connection terminals 71, 72 of the first contact part 70 sandwiched by the first and second connection terminals 31, 32 of the first contact part 30. More specifically, the first connection terminal 31 is connected to the fourth connection terminal 72 by contacting at the contact region 73 of the first contact part 71; and the second connection terminal 32 is connected to the third connection terminal 71 at the contact region 33 of the first contact part 30. Although an electrical connection can be established by having the first contact part 30 contacting the first contact part 70 at a single point, the first contact parts 30, 70 are in contact at two points of the contact regions 73 and 33. Compared to contacting at a single point, the possibility of the first contact parts 30, 70 deviating from a contacting point due to vibration is reduced by the contact at two points. This improves reliability of the electrical connection of the connector apparatus 100. Further, because the first contact part 30 of the first connector 20 and the first contact part 70 of the second connector 60 are connected in a manner having the third and fourth connection terminals 71, 72 supported (sandwiched) between first and second connection terminals 31, 32, the electrical connection can be maintained even in a case where a large vibration is generated in a vertical direction.

More specifically, in a case where the first connector 20 and the second connector 60 are displaced relative to each other in an upward direction, the second connection terminal 32 and the third connection terminal 71 move in a direction separating from each other. However, the connection between the first connection terminal 31 and the fourth connection terminal 72 becomes tighter. That is, the first connection terminal 31 moves in a direction pressing against the fourth connection terminal 72. Therefore, even in a case where the second connection terminal 32 and the third connection terminal 71 are accidentally separated from each other, the first connection terminal 31 and the fourth connection terminal 72 are firmly connected. Thus, the electrical connection between the first contact part 30 of the first connector 20 and the first contact part 70 of the second connector 60 can be maintained.

Furthermore, in a case where the first connector 20 and the second connector 60 are displaced relative to each other in a downward direction, the first connection terminal 31 and the fourth connection terminal 72 move in a direction separating from each other. However, the connection between the second connection terminal 32 and the third connection terminal 71 becomes tighter. That is, the second connection terminal 32 moves in a direction pressing against the third connection terminal 71. Therefore, even in a case where the first connection terminal 31 and the fourth connection terminal 72 are accidentally separated from each other, the second connection terminal 32 and the third connection terminal 71 are firmly connected. Thus, the electrical connection between the first contact part 30 of the first connector 20 and the first contact part 70 of the second connector 60 can be maintained.

Likewise, by engaging the first and second connectors 20, 60, the second contact part 40 of the first connector 20 is connected to the second contact part 80 of the second connector 60.

That is, the first and second connectors 20, 60 are connected in a manner having the third and fourth connection terminals 81, 82 of the second contact part 80 supported (sandwiched) between the first and second connection terminals 41, 42 of the second contact part 40. More specifically, the first connection terminal 41 is connected to the fourth connection terminal 82 by contacting at the contact region 83 of the second contact part 80; and the second connection terminal 42 is connected to the third connection terminal 81 at the contact region 43 of the second contact part 40. Although the electrical connection can be established by having the second contact part 40 contacting the second contact part 80 at a single point, the second contact parts 40, 80 are in contact at two points of the contact regions 83 and 43. Compared to contacting at a single point, the possibility of the second contact parts 40, 80 deviating from a contacting point due to vibration is reduced by the contact at two points. This improves the reliability of the electrical connection of the connector apparatus 100. Further, because the first contact part 30 of the first connector 20 and the first contact part 70 of the second connector 60 are connected in a manner having the third and fourth connection terminals 81, 82 supported (sandwiched) between first and second connection terminals 41, 42, the electrical connection can be maintained even in a case where a large vibration is generated in a vertical direction.

More specifically, in a case where the first connector 20 and the second connector 60 are displaced relative to each other in an upward direction, the first connection terminal 41 and the fourth connection terminal 82 move in a direction separating from each other. However, the connection between the second connection terminal 42 and the third connection terminal 81 becomes tighter. That is, the second connection terminal 42 moves in a direction pressing against the third connection terminal 81. Therefore, even in a case where the first connection terminal 41 and the fourth connection terminal 82 are accidentally separated from each other, the second connection terminal 42 and the third connection terminal 81 are firmly connected. Thus, the electrical connection between the second contact part 40 of the first connector 20 and the second contact part 80 of the second connector 60 can be maintained.

Furthermore, in a case where the first connector 20 and the second connector 60 are displaced relative to each other in a downward direction, the second connection terminal 42 and the third connection terminal 81 move in a direction separating from each other. However, the connection between the first connection terminal 41 and the fourth connection terminal 82 becomes tighter. That is, the first connection terminal 41 moves in a direction pressing against the fourth connection terminal 82. Therefore, even in a case where the second connection terminal 42 and the third connection terminal 81 are accidentally separated from each other, the first connection terminal 41 and the fourth connection terminal 82 are firmly connected. Thus, the electrical connection between the second contact part 40 of the first connector 20 and the second contact part 80 of the second connector 60 can be maintained.

Hence, even in a case where the connector apparatus 100 is used in an environment where vibration is generated, the electrical connection can be positively maintained.

Next, first and second connectors 110, 120 according to another embodiment of the present invention is described with reference to FIGS. 6 and 7.

Figure 6:
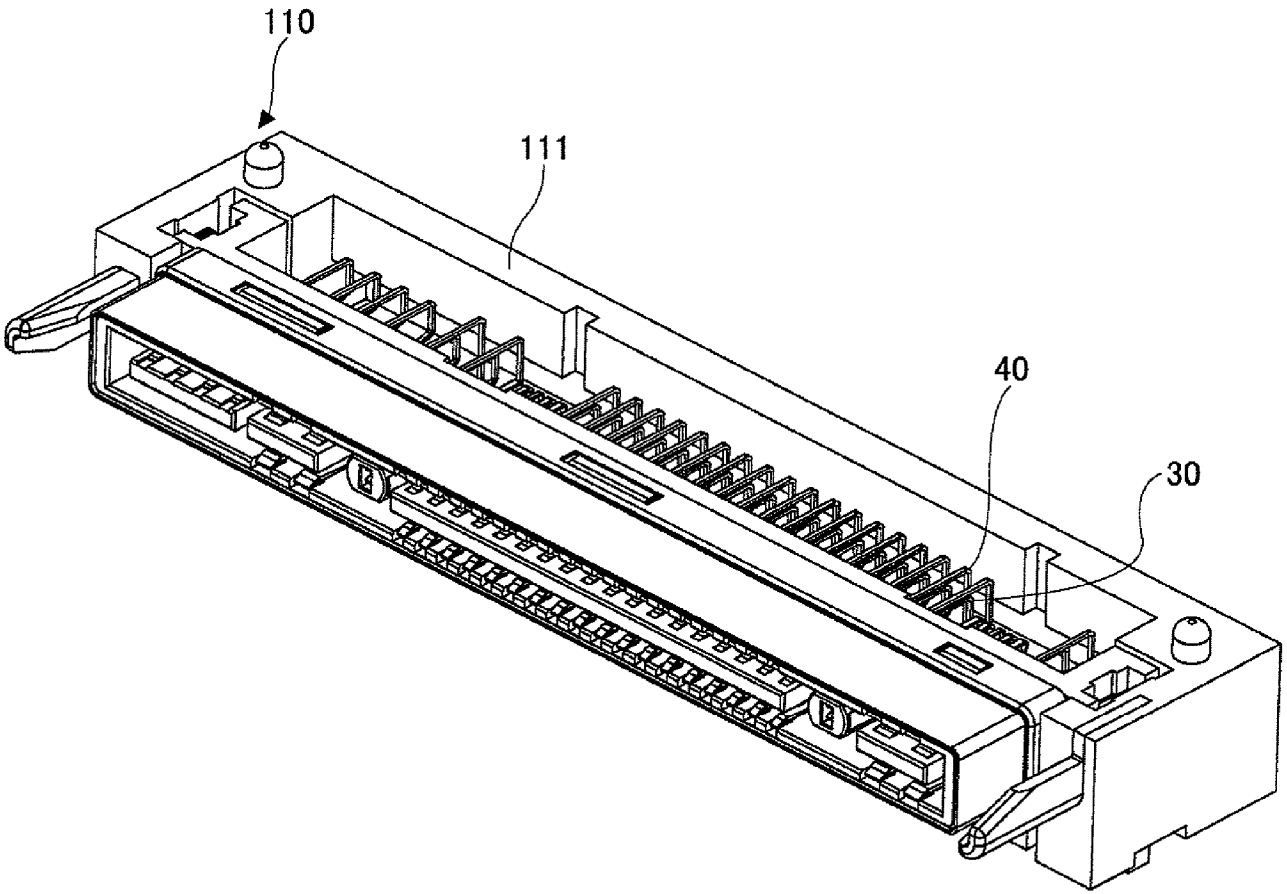
FIG. 6 is a schematic diagram illustrating a first connector having an arrangement of plural first and second contact parts according to another embodiment of the present invention.

FIG. 6 is a schematic diagram illustrating the first connector 110 having an arrangement of plural first and second contact parts 30, 40 according to another embodiment of the present invention. The first connector 110 includes a housing 111 in which the plural first and second contact parts 30, 40 are installed. The plural first and second contact parts 30, 40 are arranged substantially in parallel. Each of the plural first contact parts 30 includes the first contact terminal 31 and the second contact terminal 32. Each of the plural second contact parts 40 includes the first contact terminal 41 and the second contact terminal 42.

Figure 7:
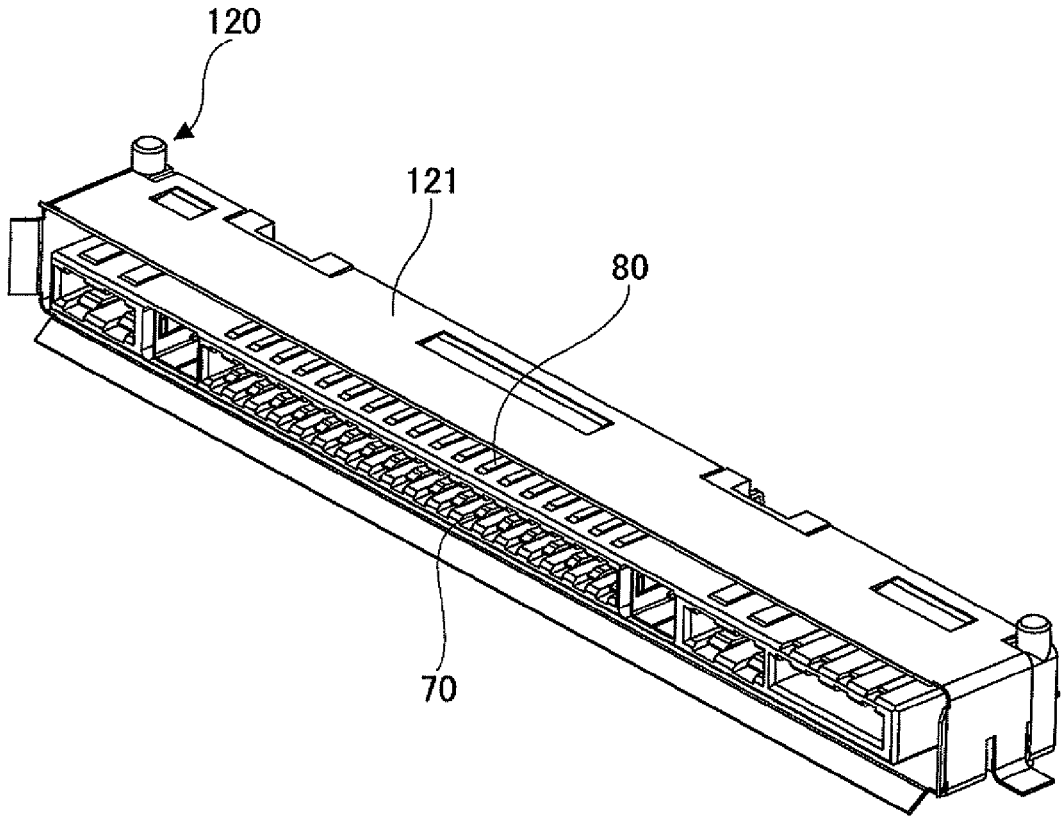
FIG. 7 is a schematic diagram illustrating a second connector having an arrangement of plural first and second contact parts according to another embodiment of the present invention.

FIG. 7 is a schematic diagram illustrating the second connector 120 having an arrangement of plural first and second contact parts 70, 80 according to another embodiment of the present invention. The second connector 120 includes a housing 121 in which the plural first and second contact parts 70, 80 are installed. The plural first and second contact parts 70, 80 are arranged substantially in parallel. Each of the plural first contact parts 70 includes the third contact terminal 71 and the fourth contact terminal 72. Each of the plural second contact parts 80 includes the third contact terminal 81 and the fourth contact terminal 82.

The connector apparatus 100 according to another embodiment of the present invention may be configured having the first and second connectors 110, 120 engaged therein With the above-described embodiments of the connector apparatus 100, the electrical connection can be reliably maintained even in an atmosphere where there is constant vibration (e.g., inside of an automobile) because the electrical connection is attained by connection at two points.

Further, the present invention is not limited to these embodiments, but variations and modifications may be made without departing from the scope of the present invention.

The present application is based on Japanese Priority Application No. 2009-138839 filed on Jun. 10, 2009, with the Japanese Patent Office, the entire contents of which are hereby incorporated by reference.

What is claimed is:

1. A connector apparatus comprising:

a first connector including a first contact part, the first contact part including first and second contact terminals connected by a first connection part, the first and second contact terminals having a space therebetween, the second contact terminal having a first bent part bent in a manner that the space between the first and second contact terminals becomes narrower; and a second connector engageable to the first connector and including a second contact part, the second contact part including third and fourth contact terminals connected by a second connection part, the third and fourth contact terminals having a space therebetween, the fourth contact terminal having a second bent part bent in a manner that the space between the third and fourth contact terminals becomes wider;

wherein each of the first, the second, the third, and the fourth contact terminals has a flat plate shape, and wherein when the first and second connectors are in an engaged state, the first contact part and the second contact part are connected in a manner having the third and fourth connection terminals sandwiched between the first and second connection terminals, having the first contact terminal contact the fourth contact terminal, and having the second contact terminal contact the third contact terminal.

2. The connector apparatus as claimed in claim 1, wherein the first and second contact terminals are arranged substantially in parallel, and wherein the third and fourth contact terminals are arranged substantially in parallel.

3. The connector apparatus as claimed in claim 1, wherein the second and fourth contact terminals have a resilient property.

4. The connector apparatus as claimed in claim 1, wherein the first contact part includes a lead part is formed in a manner extending in a direction in which the first contact terminal extends, and wherein the second contact part includes another lead part formed in a manner extending in a direction in which the third contact terminal extends.

5. The connector apparatus as claimed in claim 1, wherein the first contact part includes a lead part is formed in a manner extending in a direction in which the first connection part extends, and wherein the second contact part includes another lead part formed in a manner extending in a direction in which the second connection part extends.

6. The connector apparatus as claimed in claim 1, wherein the first and second contact terminals are formed with the same material, and wherein the third and fourth contact terminals are formed with the same material.

7. The connector apparatus as claimed in claim 1, wherein the first connector further includes one or more contact parts having the same configuration as the first contact part, and wherein the second connector further includes one or more contact parts having the same configuration as the second contact part.

8. The connector apparatus as claimed in claim 1, wherein the first contact terminal is substantially straight.

9. The connector apparatus as claimed in claim 8, wherein the third contact terminal is substantially straight.

10. The connector apparatus as claimed in claim 1, wherein the first bent part is positioned at a center of the second contact terminal, and wherein the second bent part is positioned at a center of the fourth contact terminal.

11. The connector apparatus as claimed in claim 10, wherein the second contact terminal further includes a third bent part bent in an opposite direction to the first bent part at a vicinity of tip portion thereof, and wherein the fourth contact terminal further includes a fourth bent part bent in an opposite direction to the second bent part at a vicinity of tip portion thereof.

12. The connector apparatus as claimed in claim 1, wherein the space between the first and second contact terminals becomes narrower at distal end parts of the first and second contact terminals, and wherein the space between the third and fourth contact terminals becomes wider at distal end parts of the third and fourth contact terminals.

* * * * *